US009826785B2

(12) United States Patent
Blacker

(10) Patent No.: US 9,826,785 B2
(45) Date of Patent: Nov. 28, 2017

(54) MULTI-FUNCTION BREASTFEEDING AND PUMPING GARMENT

(71) Applicant: Rachel Kathryn Blacker, Las Vegas, NV (US)

(72) Inventor: Rachel Kathryn Blacker, Las Vegas, NV (US)

( * ) Notice: Subject to any disclaimer, the term of this patent is extended or adjusted under 35 U.S.C. 154(b) by 78 days.

(21) Appl. No.: 14/791,938

(22) Filed: Jul. 6, 2015

(65) Prior Publication Data

US 2016/0007659 A1 Jan. 14, 2016

Related U.S. Application Data

(60) Provisional application No. 62/024,184, filed on Jul. 14, 2014.

(51) Int. Cl.

| | |
|---|---|
| ***A41C 3/04*** | (2006.01) |
| ***A41D 1/20*** | (2006.01) |
| ***A41D 27/04*** | (2006.01) |

(52) U.S. Cl.

CPC ..... *A41D 1/205* (2013.01); *A41C 3/04* (2013.01); *A41D 27/04* (2013.01)

(58) Field of Classification Search

CPC ..... A41D 27/04; A41D 1/205; A41C 3/04; A41C 3/08; A41C 3/0014

USPC ..... 2/104, 69; 450/36

See application file for complete search history.

(56) References Cited

U.S. PATENT DOCUMENTS

| | | | | |
|---|---|---|---|---|
| 2,141,239 | A * | 12/1938 | Diamond | A41D 27/24 112/414 |
| 5,461,725 | A * | 10/1995 | Witczak | A41D 1/205 2/104 |
| 6,282,719 | B1 * | 9/2001 | Vera | A41D 1/205 2/104 |
| 8,226,452 | B2 * | 7/2012 | Hendrickson | A41C 3/04 2/104 |
| 2009/0265830 | A1 * | 10/2009 | Hendrickson | A41D 1/205 2/104 |
| 2012/0184179 | A1 * | 7/2012 | Blitz | A41C 3/04 450/36 |
| 2013/0232661 | A1 * | 9/2013 | Huntley | A41D 1/205 2/104 |

* cited by examiner

*Primary Examiner* — Katherine Moran
(74) *Attorney, Agent, or Firm* — David Einfeldt

(57) ABSTRACT

An apparatus and system for facilitating breast milk pumping and breastfeeding in a discreet and comfortable manner. The apparatus including a bandeau provided within a covering shirt. The bandeau can include a pair of apertures corresponding in location to a wearer's nipples which provide access through the bandeau to the wearer's nipples for pumping purposes. Further, the bandeau and covering shirt being formed of a resilient material for exposing one or both breasts, or alternatively uncovering only the bandeau.

19 Claims, 9 Drawing Sheets

MULTI-FUNCTION BREASTFEEDING AND PUMPING GARMENT

PRIORITY CLAIM

Priority is claimed to U.S. Provisional Patent Application Ser. No. 62/024,184, filed Jul. 14, 2014, which is hereby incorporated herein by reference in its entirety.

COPYRIGHT STATEMENT

A portion of this patent application document contains material that is subject to copyright protection including the drawings. The copyright owner has no objection to the facsimile reproduction by anyone of the patent document or the patent disclosure as it appears in the Patent and Trademark Office file or records, but otherwise reserves all copyright rights whatsoever.

BACKGROUND

Field of the Invention

The present invention relates generally to consumer maternity products. More particularly, the present invention relates to a shirt and bandeau combination for use by mothers who desire to nurse their children or pump breast milk in a modest yet comfortable and accessible manner.

Related Art

It will be appreciated by those skilled in the art that babies are often in need of their mother's milk, and that the feeding schedule of babies does not always necessarily coincide with the external scheduling demands of new mothers. As such, babies will often need to breastfeed in public, or in otherwise less than private situations. Additionally, the mother will not necessarily always be with their baby when the lactation begins or the breastmilk otherwise needs to be extracted. As such, mothers often utilize breast pumps in order to extract milk and preserve it for a later feeding of the baby using, for example, a bottle.

Various nursing bras presently available to nursing mothers typically include large panels which can be unclipped allowing the panels to be pulled away, thus exposing the breast and allowing access of the child or a breast pump cone to the exposed breast. Problems arise because outer clothing items, i.e. shirts, blouses, etc., which are suitable for everyday use in public, do not typically allow for easy access to the breasts without substantial inconvenience, often requiring being pulled up from the bottom so as to expose substantial portions of the stomach and shoulders in order to properly gain access to a desired breast, wherein such significant exposure is often not desired, such as in public locations. Some products also involve using large blanket type covers which can cover the mother's torso such that the mother can sufficiently undress under the cover. The problem with such covers is that breastfeeding babies often dislike being covered while awake and feeding and can push the cover away, which exposes the undressed mother's torso, almost completely. Such covers also still require a significant amount of undressing under the cover.

It will be further appreciated that providing more secure and convenient comfort to nursing mothers is a continuing endeavor. The present invention overcomes many of the deficiencies present in the products presently available. Some such advantages will be discussed in more detail below.

BRIEF DESCRIPTION OF THE DRAWINGS

Additional features and advantages of the invention will be apparent from the detailed description which follows, taken in conjunction with the accompanying drawings, which together illustrate, by way of example, features of the invention; and, wherein.

Figure 1:
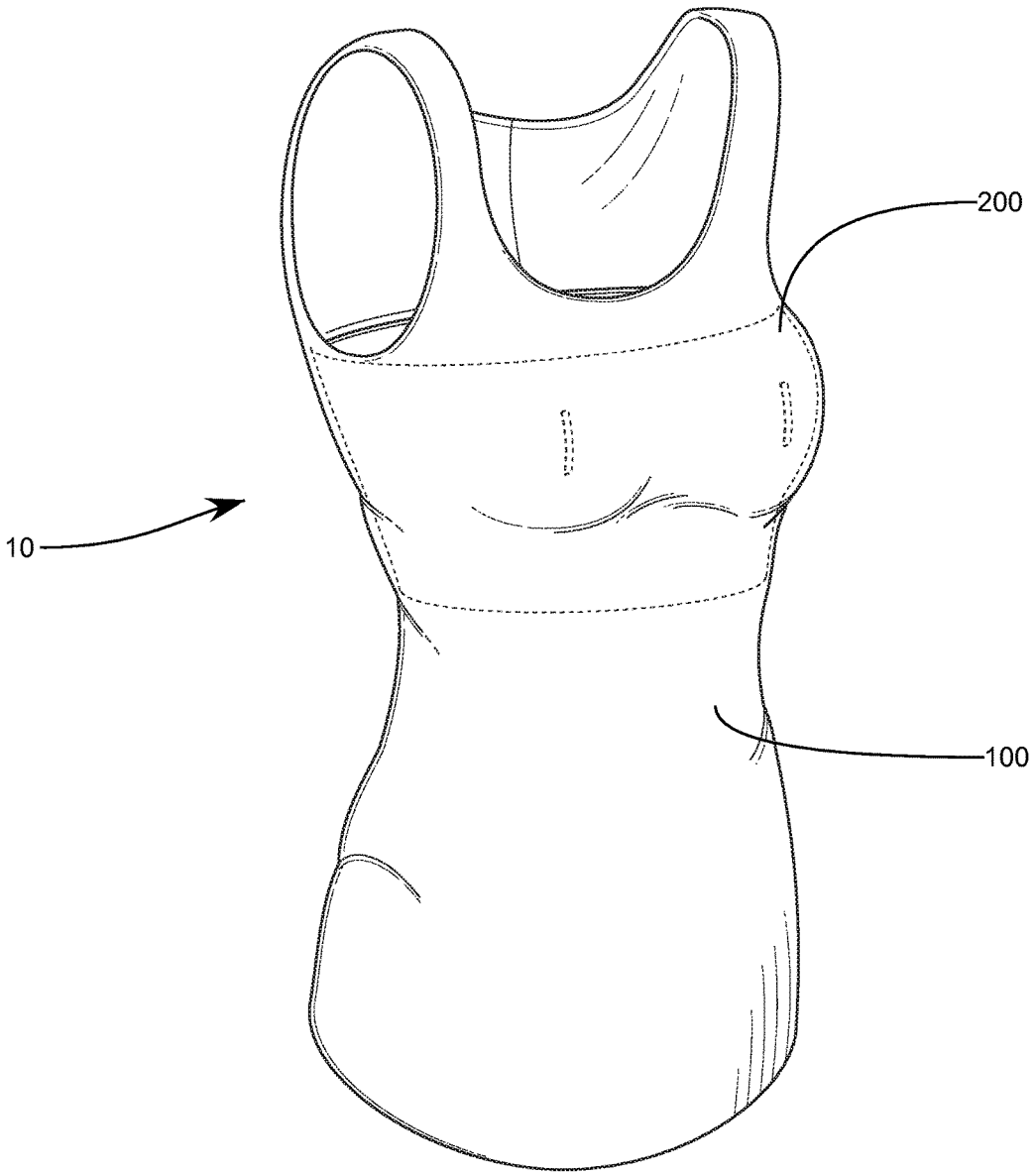
FIG. 1 illustrates a perspective view of a front portion of a multi-function breast feeding and pumping garment in accordance with various aspects of the present invention.
Figure 2:
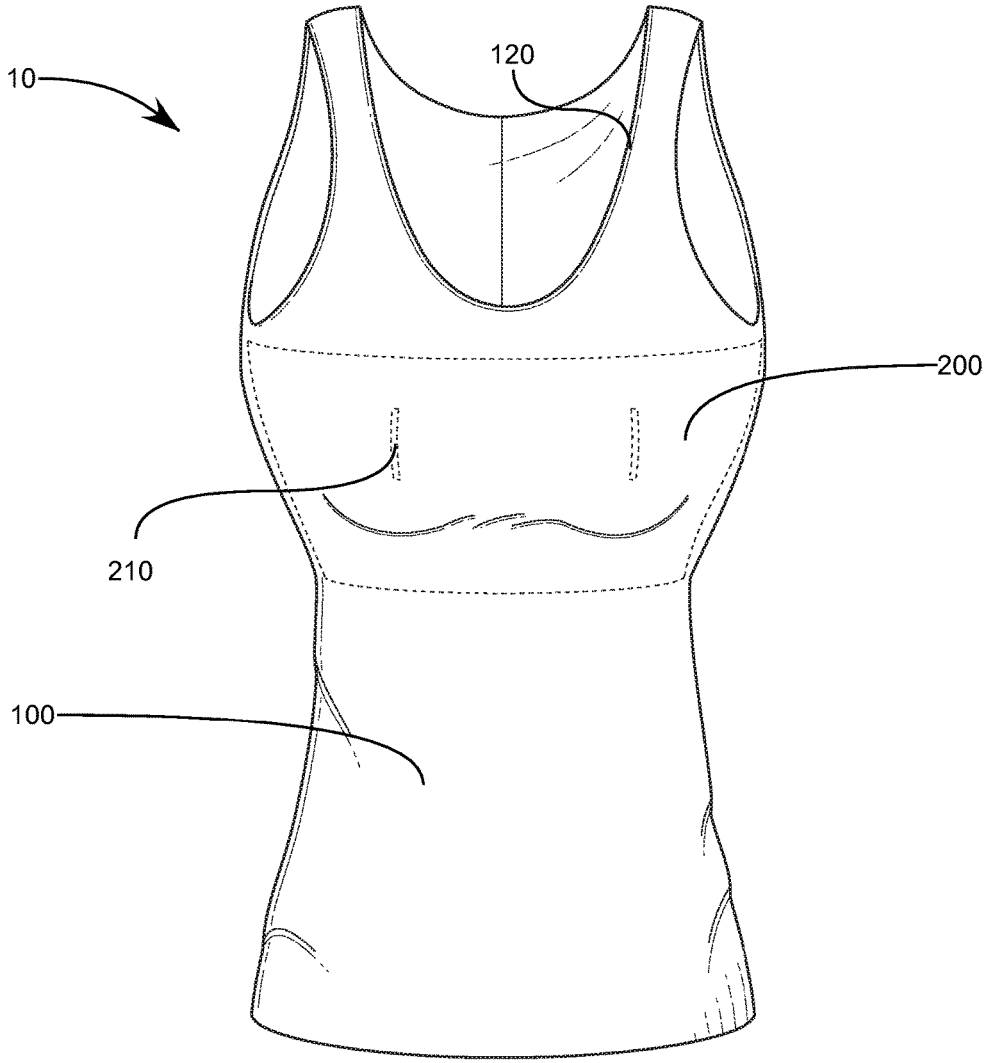
FIG. 2 illustrates a front view of a multi-function breast feeding and pumping garment in accordance with the embodiment shown in FIG. 1.
Figure 3:
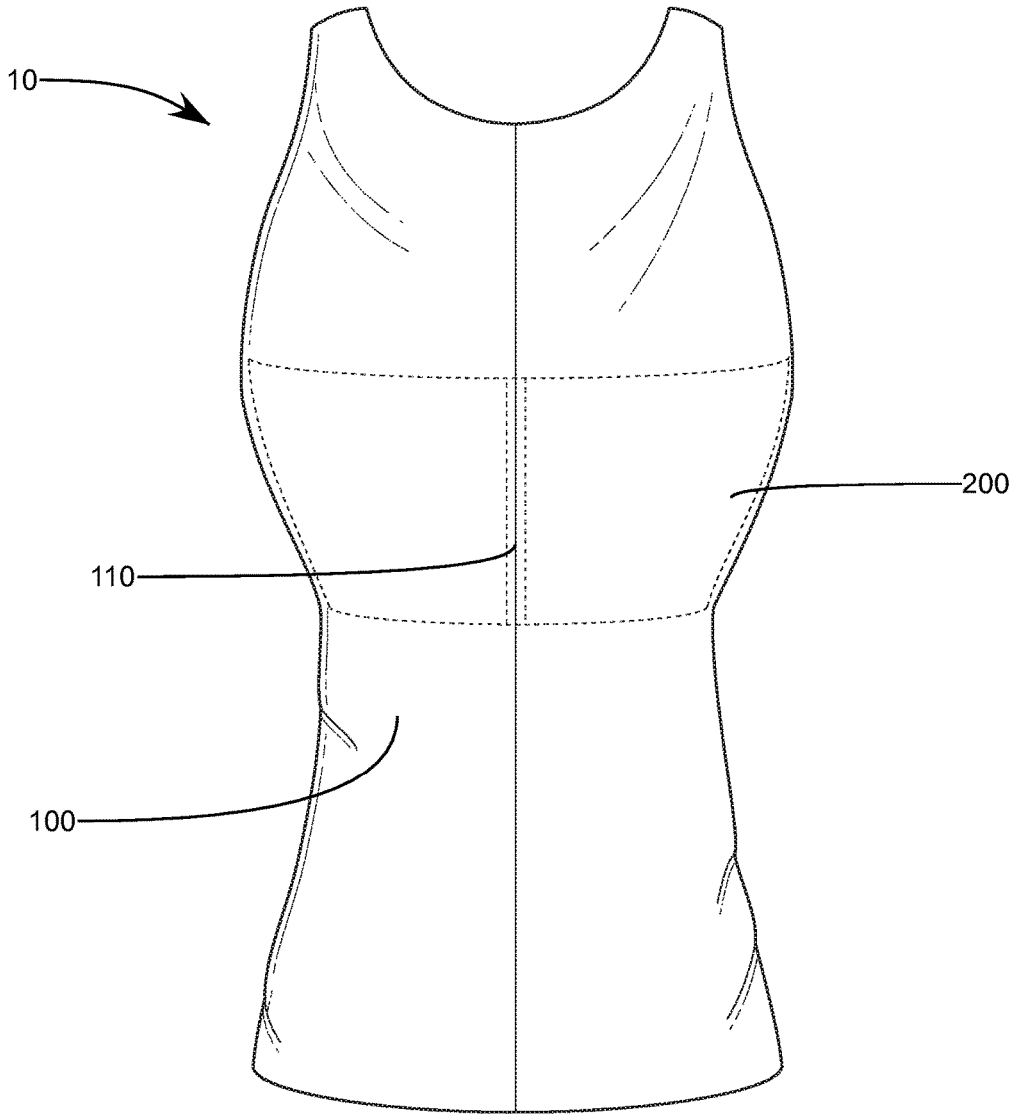
FIG. 3 illustrates a back view of a multi-function breast feeding and pumping garment in accordance with the embodiment shown in FIG. 1.

Reference will now be made to the exemplary embodiments illustrated, and specific language will be used herein to describe the same. It will nevertheless be understood that no limitation of the scope of the invention is thereby intended though the exemplary embodiments discussed, but the examples are for purposes of illustration of the inventive concepts.

SUMMARY OF THE INVENTION

A multi-function breastfeeding garment is contemplated herein which includes an outer shirt as well as an inner bandeau. The bandeau can be provided having a generally cylindrical shape and having an annular wall structure. The bandeau can be configured to wrap around the user's upper torso, preferably, but not mandatorily, underneath the user's arms. The bandeau can include a pair of apertures being formed in a front portion of the annular wall structure, the pair of apertures extending from an exterior surface to an inner surface. In this manner the pair of apertures can allow access to the user's nipples, for purposes of breastmilk extraction, without removal of the bandeau and the exposure that would be associated with such a removal.

The bandeau can be permanently affixed to the outer shirt using, for example, a stitched seam, or alternatively, the bandeau and outer shirt can be provided with removable attachment means. In one embodiment the seam connecting the bandeau to the outer shirt can optionally be located along a spinal portion in a rear panel of both the bandeau and the outer shirt.

The bandeau can also include a pair of apertures for accessing the user's nipples through the bandeau as well as a pair of inner covers, each cover configured to selectively cover one of the corresponding apertures. These inner covers can each attached to the bandeau at distal edges being located about the user's flanks. The inner covers can include a plurality of layers of material which provide comfort as well as moisture absorption. In order to facilitate absorption the inner covers can include a plurality of layers wherein at least one layer is formed of an absorbent material. In order to prevent moisture from penetrating through the inner covers and potentially to the exterior of the outer shirt one of the plurality of layers can include at least one impermeable material being positioned away from the user's skin.

A back surface of the bandeau can also include a first component of a hook and loop fastening system and an opposing surface of the inner covers can be provided as a second component of the hook and loop fastening system so as to facilitate securing the placement of the inner covers with respect to the bandeau.

The bandeau can also be provided with an elastic seam at an upper edge, the elastic seam being configured to resiliently stretch over and expose the user's breast without plastic deformation. Similarly, the outer shirt can be provided with an elastic seam through a shoulder portion, the elastic seam being configured to resiliently stretch over and expose the front portion of the bandeau or one or both of the user's breasts without plastic deformation.

In another aspect of the present invention, a method of providing a multi-function breastfeeding garment is contemplated wherein each of the components enumerated above are provided in varying combinations.

DETAILED DESCRIPTION OF EXAMPLE EMBODIMENT(S)

FIGS. 1-9, illustrate an exemplary embodiment of a multi-function breastfeeding garment 10 which overcomes various deficiencies of nursing garments or covers as existing in the prior art. The Garment is intended to be worn by a user, wherein the user is a nursing mother who either breastfeeds directly, pumps breast milk for bottle feeding, or both.

The multi-function breastfeeding garment 10 is intended to be suitable for wearing in public, be fashionable, and not readily apparent that the multi-function breastfeeding garment 10 is a piece of functional clothing.

As such the multi-function breastfeeding garment 10 includes two primary components, the first of which is an exterior shirt 100, the second of which is a bandeau 200 located and worn inside of the exterior shirt 100.

The bandeau 200 can be provided with a pair of apertures 210 which extend through the bandeau 200. The apertures 210 are located such that they provide access through the bandeau 200 to the user's nipples without requiring exposing any additional area of the user's breast.

Figure 4:
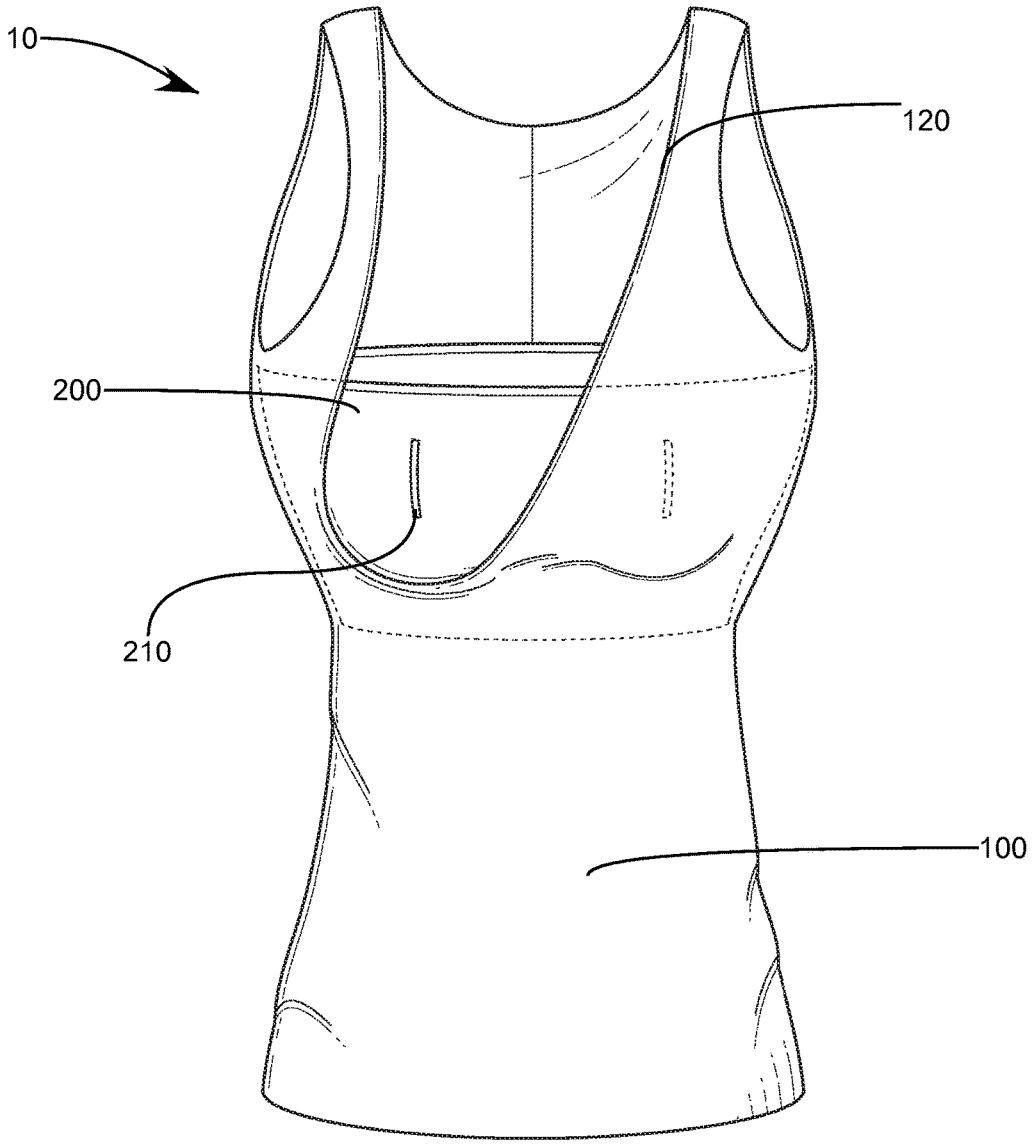
FIG. 4 illustrates a front view of one function of the multi-function breast feeding and pumping garment in accordance with the embodiment shown in FIG. 1.
Figure 5:
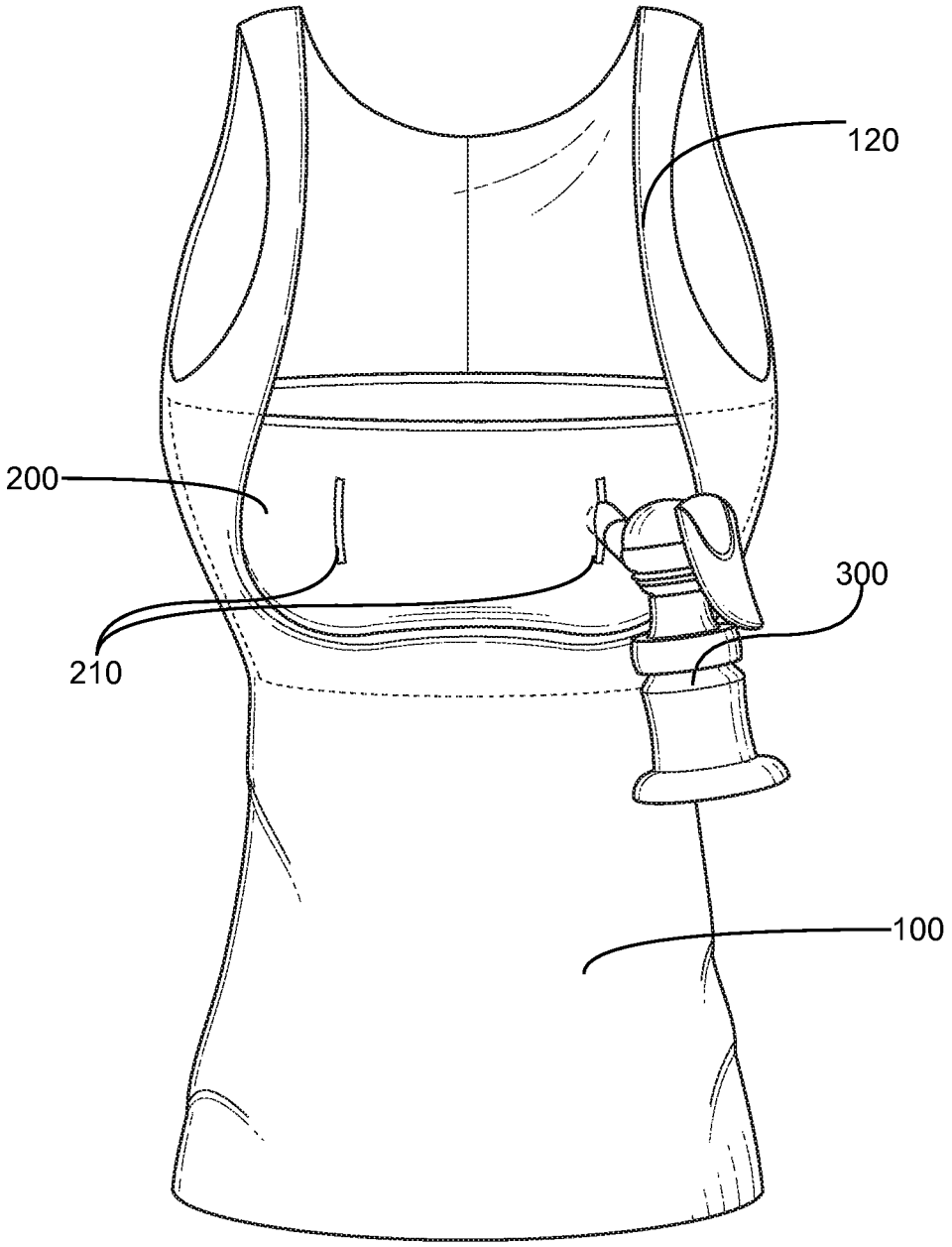
FIG. 5 illustrates a front view of another function of the multi-function breast feeding and pumping garment in accordance with the embodiment shown in FIG. 1.

The exterior shirt 100 can be provided with an elastic seam 120 at a neck portion as well as at the arms apertures such that the exterior shirt 100 can be pulled down to expose the bandeau 200 without complete or even partial removal of the exterior shirt. This pulled away configuration is illustrated in FIGS. 4-5, wherein the exterior shirt 100 is pulled down to access one or both of the user's nipples through the bandeau 200.

Figure 6:
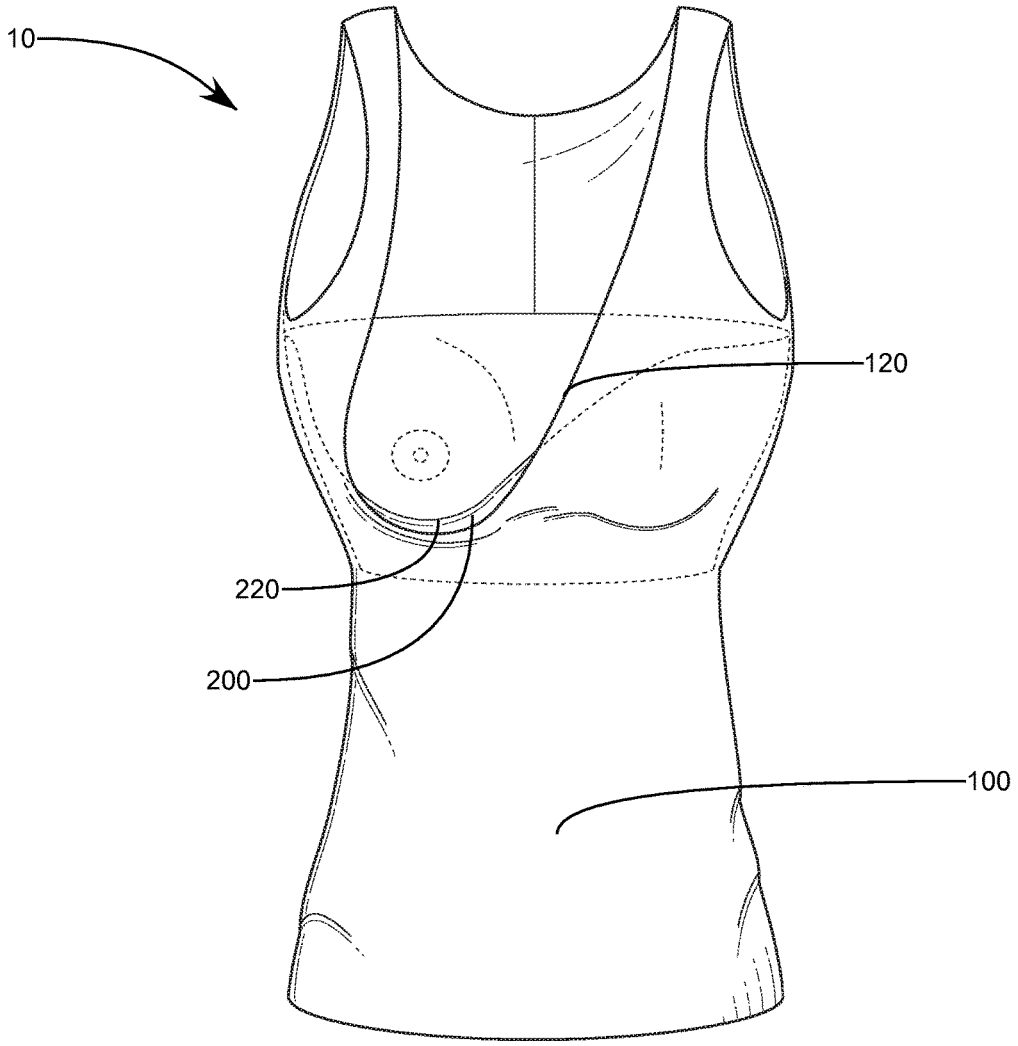
FIG. 6 illustrates a front view of yet another function of the multi-function breast feeding and pumping garment in accordance with the embodiment shown in FIG. 1.

The bandeau can also be provided with an elastic seam 220 at an upper portion such that it can also be pulled down to expose one or both of the user's breasts as seen in FIG. 6. This configuration can be useful for direct breastfeeding of a child or in instances wherein a user's breast pump, as illustrated by 300 in FIG. 5, is too difficult or uncomfortable to use through a desired aperture 210.

In other alternative instances, the exterior shirt 100 can be pulled down to fully expose the front portion of the bandeau 200, wherein the bandeau can be pulled down to selectively expose one breast to directly breastfeed a child, while the nipple of the other breast is accessed through the bandeau 200 to utilize a breast pump on the other breast.

In some embodiments the bandeau 200 and the exterior shirt 100 can be permanently affixed to one another via a seam 110. One or more seams can be provided connecting the bandeau 200 to the exterior shirt 100, wherein in the case of multiple seams, they can be provided at different spacing or locations about an outer perimeter of the exterior shirt 100 and the bandeau 200. It has been recognized that a single seam provided from a top portion to a bottom portion along a spinal area has been particularly advantageous. It has further been appreciated that an expandable stitching method allows for the stretching of the material so as to better conform to variations in individual user body contours and dimensions. Further, flat seams also provide increased comfort when sitting and applying pressure, such as when sitting in a chair having back support, such that the seam does not provide an irritation point to the user. However, this seam can be provided along a flank portion at varying intervals as well, insomuch that the placement of the seams does not constrict the exterior shirt's and bandeau's ability to be pulled down in a front portion for accessing one or both breasts.

Figure 7A:
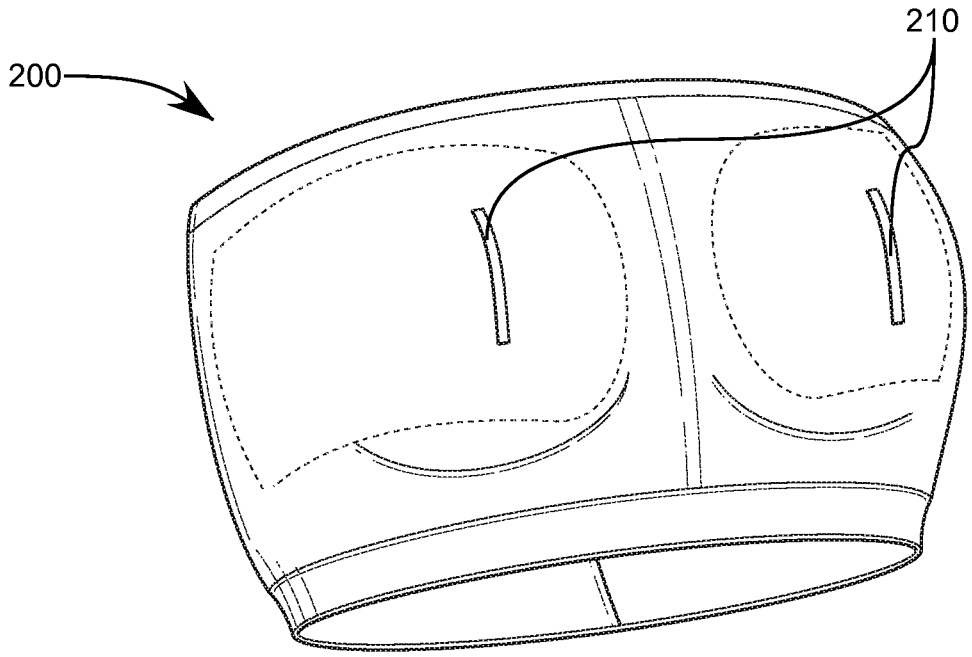
FIGS. 7A-B illustrate a perspective views of a front portion of a bandeau having different aperture orientations in accordance with various bandeau embodiments for use in the multi-function breast feeding and pumping garment of FIG. 1.
Figure 7B:
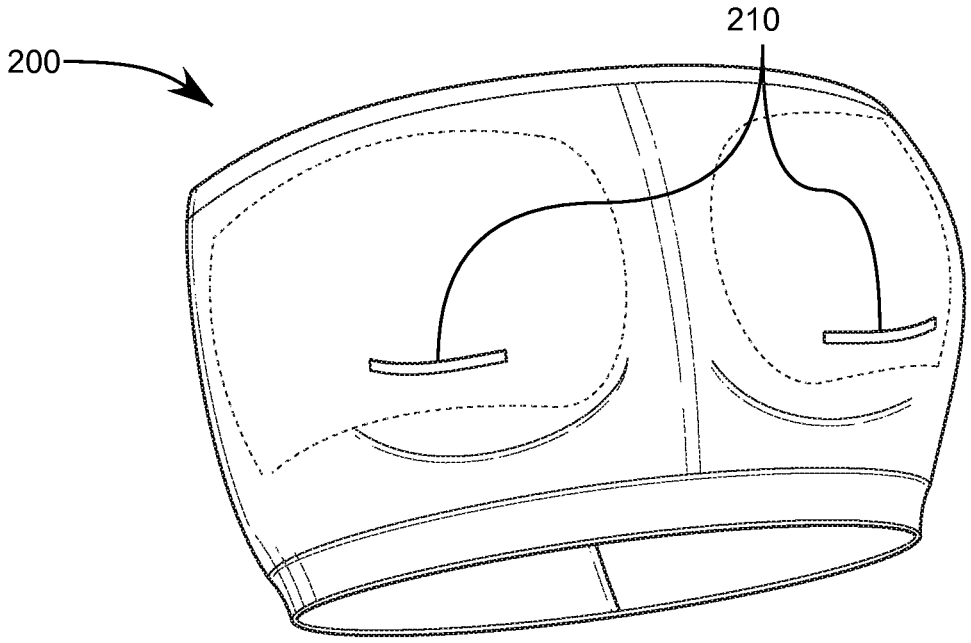
Figure 8:
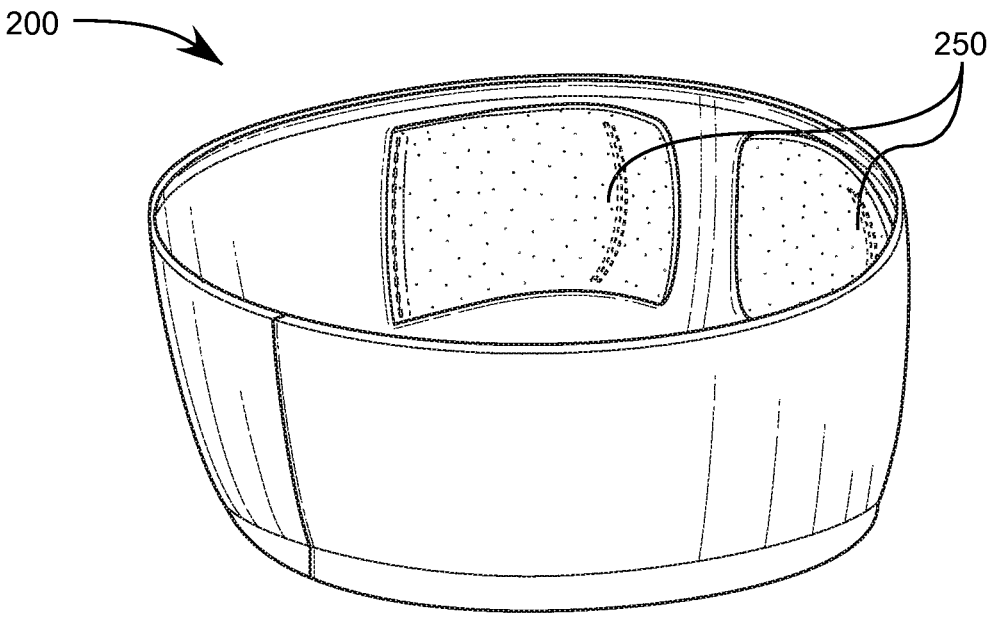
FIG. 8 illustrates a perspective view of a rear portion of a bandeau in accordance for use in the multi-function breast feeding and pumping garment of FIG. 1.

FIGS. 7-9 illustrate the bandeau 200 in more detail. In particular, FIGS. 7-9 illustrate a pair of internal covers 250 which can be configured to be in direct contact with the user's skin and cover the inner surface of the bandeau 200 between the bandeau 200 and the user's breasts. These internal covers 250 provide various functions, the functions being at least to protect the user's breasts and nipples from rubbing against, and potentially becoming irritated by the apertures 210, wherein the use of a reinforcing stitching about the apertures can potentially be increased drastically. Another function the inner covers can also provide is to prevent premature lactation from saturating the bandeau 200 and potentially leaking through and being shown through the exterior shirt 100.

Additionally, as illustrated in FIG. 7A, the apertures 210 can be provided as a pair of vertical slits. It will be appreciated that the aperture locations can be provided in varying locations so as to be customizable to the user's individual nipple location. Alternatively, the apertures 210 can be provided in virtually any configuration, such as horizontal slits as shown in FIG. 7B, or any number of additional geometric patterns, "X" shapes, or any number of other conceivable configurations. Slits can be advantageous because reinforcement stitching, similar to a button hole, can be provided so as to reinforce the aperture 210 and prevent tearing of the material forming the bandeau 200. The horizontal aperture orientation, as shown in FIG. 7B, can be of particular advantage because the apertures 210 can be located at a point below the curve of the breast.

Figures 9A, 9B:
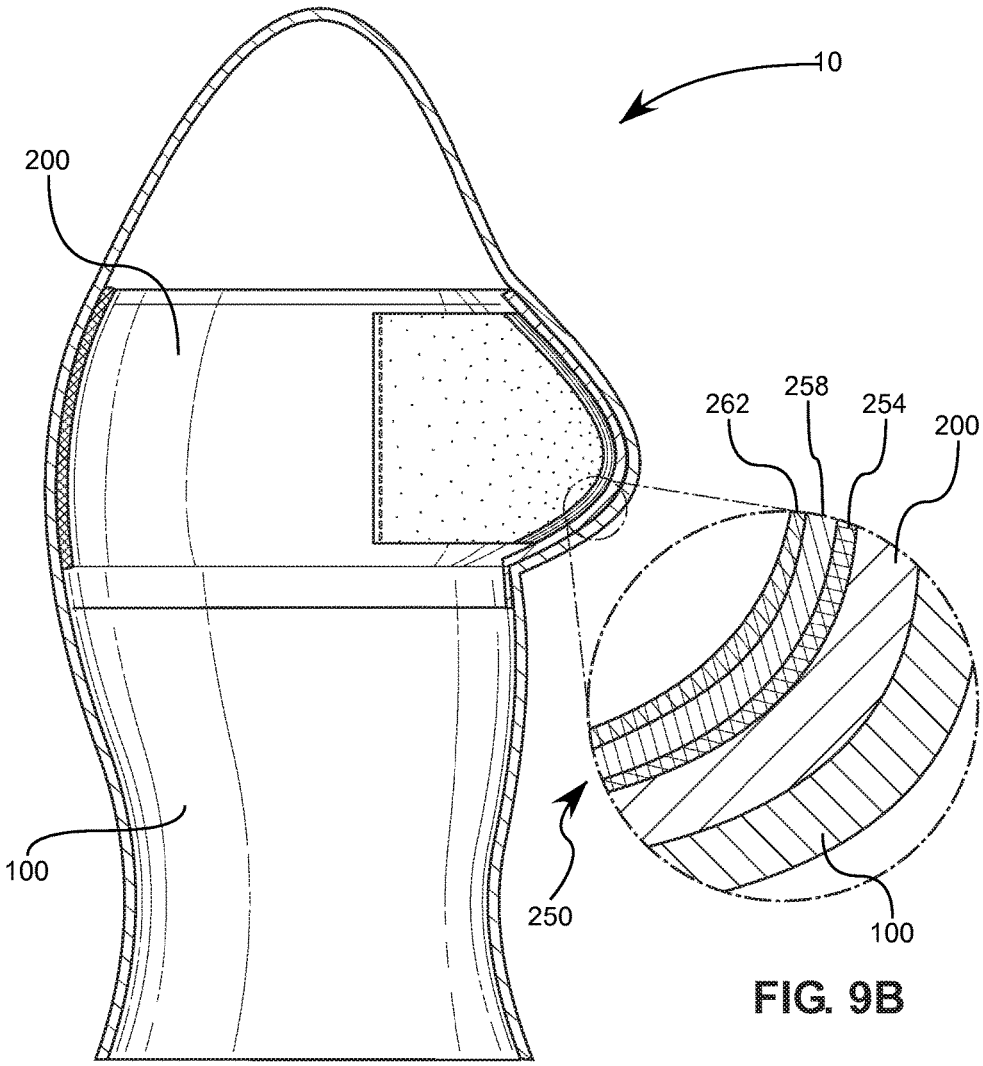
FIG. 9A illustrates a cross sectional side view of the multi-function breast feeding and pumping garment of FIG. 1.
FIG. 9B illustrates an enlarged cross sectional view of an indicated area encompassed by the dotted lines of FIG. 9A.

As best seen in FIG. 9B the inner covers 250 can be provided with a plurality of layers. The plurality of layers can include an absorbent layer 262, which can double as a soft or comfortable irritation reducing layer which rests directly against the user's skin. A second impermeable layer 258 can also be provided away from the user's skin sandwiching the absorbent layer against the user's breast or nipples so as to prevent excess milk from leaking through to the front of the exterior shirt. In some embodiments only a single absorbent, or alternatively an impermeable layer can be used so as to meet the particular needs of the user.

In addition the inner covers 250 can be provided with a placement assisting layer 254. In one embodiment the placement assisting layer can be provided as a first or second component of a hook and loop fastening system wherein the inner surface of the bandeau is provided as the corresponding component of the hook and loop fastening system. In this manner, the inner covers can be "stuck" to the bandeau so as to secure their relative placement with respect to the bandeau. In this manner the covers will resist slipping out of position during normal wearing. Alternative embodiments can include a high friction fabric or self-adhering polymers provided between the inner covers and the interior surface of the bandeau.

It will be further appreciated that the plurality of layers and their respective functions can be provided in any suitable combination, and in any suitable order.

Additionally, some embodiments will have no inner covers at all, or can also be optionally provided with removable inner covers with a desired attachment means. This attachment means can be a hook and loop fastening system, as described above, or the attachment means can be provided as snaps, buttons, hooks, or any number of common fabric attachment means as will be appreciated by those of ordinary skill having possession of this disclosure. Additionally the absorbent layer can be provided as fixed or removable pad formed of a washable material, or alternatively the absorbent layer can be removable and provided as a disposable material. It will be appreciated that the inner covers can be removable and replaceable, or alternatively the covers can be permanently affixed with a separable or replaceable absorbent pad insert. The absorbent pads, or inserts, can utilize snaps, hook, and loop fasteners, buttons, or any number of attachment means as will be appreciated by those having skill in the art in order to securely place the pads or inner covers during use.

Further, in the embodiments shown, the inner covers shown are provided as flaps which are affixed to the bandeau at distal edges about the flanks of the user when in use. However, the inner covers can be provided as separable, or can be affixed to the bandeau in any number of locations and in any number of varieties as will be recognized by those of ordinary skill in possession of this disclosure. Such orientations can include extending from a bottom or top edge of the bandeau, extending from a sternum location outward toward the flanks, etc. The shown attachment method is for purposes of illustration only. Additionally, in the event of providing removable inner covers, the attachment means can include buttons, snaps, hook and loop fastening systems, self-adhering polymers, magnets, etc. Each potential variation also residing within the present scope of the invention.

Additionally, although not shown herein, in order to further increase the aesthetic properties of the multi-function breastfeeding garment 10, exterior covers being similar to the inner covers can be provided on the exterior surface of the bandeau 200.

The inner covers are also shown as being separate and distinct covers corresponding to independent apertures. However, the inner covers can also be provided as a single unitary construction being interconnected.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Further, discussion with regard to any of the specific features is intended to be for illustrative purposes, with the understanding that any feature discussed herein can be used in combination with any number of other features in any combination. Accordingly, it is not intended that the invention be limited, except as by the claims set forth below.

The invention claimed is:

1. A multi-function breastfeeding garment, the garment comprising:

an outer shirt;

an inner bandeau being generally cylindrical in shape and having an annular wall structure, an upper edge, and a lower edge, the upper edge being parallel to the lower edge about an entire circumference of the bandeau, the bandeau being configured to wrap around the user's upper torso, an upper edge of the bandeau being configured to rest completely below the user's armpits, and a lower edge of the bandeau resting above the user's stomach, the bandeau further comprising:

a pair of apertures being formed in a front portion of the annular wall structure, the pair of apertures extending from an exterior surface to an inner surface, the pair of apertures being further configured to allow access to the user's nipples without removal of the bandeau; and a seam coupling the bandeau to the outer shirt.

2. The garment of claim 1, wherein the bandeau further comprises:

a pair of inner covers, one cover configured to selectively cover each of the apertures.

3. The garment of claim 2, wherein the inner covers are each attached to the bandeau at an edge portion of the inner covers about a portion of the bandeau being configured to be located about each of the user's flanks.

4. The garment of claim 2, wherein the inner covers include a plurality of layers of material.

5. The garment of claim 4, wherein the plurality of layers includes at least one absorbent material.

6. The garment of claim 4, wherein the plurality of layers includes at least one impermeable material being configured to be positioned away from the user's skin.

7. The garment of claim 5, wherein the plurality of layers includes at least one impermeable material being configured to be positioned away from the user's skin and wherein the absorbent material is configured to be positioned against the user's skin.

8. The garment of claim 2, wherein the inner surface of the bandeau further comprises a first component of a hook and loop fastening system and an opposing surface of the inner covers further comprises a second component of the hook and loop fastening system so as to facilitate securing the placement of the inner covers with respect to the bandeau.

9. The garment of claim 1, wherein an upper seam of the bandeau is provided as an elastic seam, the elastic seam being configured to resiliently stretch over and expose the user's breast without plastic deformation.

10. The garment of claim 9, wherein the outer shirt further comprises an elastic seam through a shoulder portion, the elastic seam being configured to resiliently stretch over and expose the front portion of the bandeau without plastic deformation.

11. The garment of claim 1, wherein the outer shirt further comprises an elastic seam through a shoulder portion, the elastic seam being configured to resiliently stretch over and expose the front portion of the bandeau without plastic deformation.

12. The garment of claim 1, wherein the apertures of the bandeau are formed as vertical slits having resilient peripheral seams.

13. The garment of claim 1, wherein the seam coupling the bandeau to the outer shirt is located along a spinal portion in a rear panel of both the bandeau and the outer shirt.

14. A method of providing a multi-function breastfeeding garment, the method including:

providing an outer shirt;

providing an inner bandeau having an annular wall structure, an upper edge, and a lower edge, the upper edge and the lower edge being parallel to the lower edge about an entire circumference of the bandeau, the bandeau being configured to wrap around the user's upper torso, the upper edge of the bandeau being configured to rest completely below the user's armpits;

providing a pair of apertures through a front portion of the annular wall structure, the pair of apertures extending from an exterior surface to an inner surface of the bandeau, the pair of apertures being further configured to allow access to the user's nipples without removal of the bandeau; and affixing the bandeau to the outer shirt;

providing a pair of inner covers, one cover configured to selectively cover each of the apertures.

15. The method of claim 14, further comprising:

affixing the inner covers to the bandeau at an edge portion of the inner covers about a portion of the bandeau being located about the user's flanks.

16. The method of claim 14, wherein the inner covers include a plurality of layers of material.

17. The method of claim 14, wherein at least one layer of the inner covers is absorbent, and at least one additional layer is impermeable.

18. The method of claim 14, further comprising:

providing a hook and loop fastening system between the inner covers and the bandeau.

19. The method of claim 14, wherein the seam connecting the bandeau to the outer shirt is provided in a rear panel of both the bandeau and the outer shirt, wherein the seam is configured to be located along about a spinal portion of the user when worn.

* * * * *